US005152025A

United States Patent [19]

Hirmas

[11] Patent Number: 5,152,025

[45] Date of Patent: Oct. 6, 1992

[54] METHOD FOR MANUFACTURING OPEN-HEELED SHOES

[76] Inventor: Sergio Hirmas, Avda. Jorge Hirmas 2580, Renca, Santiago, Chile

[21] Appl. No.: 354,419

[22] Filed: May 18, 1989

[30] Foreign Application Priority Data

Jul. 29, 1988 [AR] Argentina ..... 311546

[51] Int. Cl.[5] ..... A43D 21/00

[52] U.S. Cl. ..... 12/145; 12/133 R

[58] Field of Search ..... 12/145, 142 S, 133 R, 12/133 A, 133 B, 141, 7.9; 425/119, 129.2

[56] References Cited

U.S. PATENT DOCUMENTS

| | | | |
|---|---|---|---|
| 1,051,955 | 2/1913 | Heilbrunn . | |
| 1,444,675 | 2/1923 | Eddins et al. | 12/141 |
| 1,757,537 | 5/1930 | Miller . | |
| 1,842,719 | 1/1932 | Dunker | 425/119 |
| 2,151,020 | 3/1939 | Fredericksen | 12/145 |
| 2,414,204 | 1/1947 | Kamborian . | |
| 2,557,535 | 6/1951 | Darragh | 12/145 |
| 3,007,184 | 11/1961 | Makovski . | |
| 3,109,701 | 11/1963 | Jacquet . | |
| 3,228,049 | 1/1966 | Sbicca | 12/141 |
| 3,306,964 | 2/1967 | Miller . | |
| 3,328,845 | 7/1967 | Ludwig . | |
| 3,474,477 | 10/1969 | London et al. . | |
| 3,521,327 | 7/1970 | Fink et al. . | |
| 3,570,151 | 3/1971 | Eaton . | |
| 3,659,301 | 5/1972 | Auberry et al. | 12/133 R |
| 3,701,273 | 10/1972 | Auberry et al. | 12/145 |
| 3,704,474 | 12/1972 | Winkler . | |
| 3,705,433 | 12/1972 | Stoddard et al. | 12/133 R |
| 3,757,436 | 9/1973 | Winkler et al. | 12/145 |
| 4,027,406 | 6/1977 | Salvatore . | |
| 4,233,758 | 11/1980 | Auberry | 12/145 |
| 4,373,275 | 2/1983 | Lydiard . | |
| 4,817,305 | 4/1989 | Wetzel | 12/133 R |

FOREIGN PATENT DOCUMENTS

| | | | |
|---|---|---|---|
| 2813378 | 10/1979 | Fed. Rep. of Germany | 12/145 |
| 510096 | 11/1920 | France | 12/145 |
| 602325 | 2/1960 | Italy | 12/145 |
| 186832 | 12/1936 | Switzerland | 12/145 |
| 27067 | of 1906 | United Kingdom | 12/145 |
| 674974 | 6/1952 | United Kingdom | 12/145 |

*Primary Examiner*—Steven N. Meyers
*Attorney, Agent, or Firm*—Kenyon & Kenyon

[57] ABSTRACT

A method and injection mold assembly for making open-heeled shoes as disclosed. A lasting string is wrap-stitched around the lower peripheral border of an upper having an open heel, and the wrap-stitching is reinforced. The upper is aligned upon a last and the lasting string is tightened such that the upper fits tightly on the last. Preferably, a teflon edge projects out from the last in a location corresponding to the superior edge of the sole in the open heeled area to protect against leakage during injection molding.

3 Claims, 8 Drawing Sheets

METHOD FOR MANUFACTURING OPEN-HEELED SHOES

FIELD OF THE INVENTION

The present invention relates to a method for manufacturing open-heeled shoes, and more particularly, to a method for making open-heeled shoes using direct injection molding techniques to attach shoe soles to uppers.

BACKGROUND OF THE INVENTION

The manufacture of shoes by the method of attaching a sole to an upper by direct injection molding is in widespread use around the world. Improvements in shoe manufacturing machinery and the materials from which shoes are made have greatly expanded the applications of this method. The manufacture of shoes by this method has allowed for the expansion of product lines from very basic styles to shoes for almost all needs due to its high efficiency and low cost.

One manner whereby shoes have been made by injection molding is commonly referred to in the art as "string lasting". In this procedure, a lasting string is attached to an "upper". The upper is a pre-cut material which forms the upper portion of the finished shoe (minus the sole). The upper has a toe portion at the front, a heel portion at the back, and sides. The lasting string is stitched around the entire lower border of an upper (the area of the upper to which the sole is attached) within a wrapping stitch. The lasting string is thereby attached to the upper, but is free to move around the border. The string is stitched such that it makes one and one-half turns around the lower border of the upper. Approximately 10 inches of the string are left at each end without stitching, to catch and pull.

The stitched upper is then placed on a last. The last is a casting which is shaped similarly to a human foot and lower leg and is part of the shoe injection mold. Similarly to the human foot, the last has a toe area in the forepart, a heel in the back, shanks in both sides between heel and toe, and a leg portion, and will be referred as such for purposes of the present disclosure. The bottom of the last, corresponding to the bottom of a human foot, will be described as inferior surface.

After the stitched upper is placed on the last, the free ends of the string are pulled strongly. The string runs inside the wrapping stitching, shortening its course while pulling the upper downward. The upper is stretched tightly against the last by this action, such that the lower border of the upper is stretched tightly against the inferior surface of the last. The end of the lasting string are tied tightly. The remaining string ends are cut away. Thus, the upper becomes "lasted", or in other words, the last becomes "dressed" with the lasted upper.

Next, the last is placed in injection position in the mold. In addition to the last, the mold also includes two sides and a bottom. When mold is shut, the sides, bottom and the dressed last (placed at the top) fit perfectly together, forming the sole cavity for injection and leaving no openings through which melted plastic can leak.

The injection molding machine includes two main functional parts, an injector and a mold carrier table. The injector has a cylinder with a rotating screw inside. Injection material is melted and pushed through the cylinder at high pressure, and passes through a nozzle at an end thereof that will make contact with the injection mold at its injection point. The mold carrier table is furnished with mold carriers where molds, according style and size needed, have been previously placed and attached by means of screws.

After the last is placed in injection position, the mold is closed and hot melted plastic, rubber or the like is injected into the mold cavity through an injection point. The injection point is an opening disposed at a point along the contact line. The melted plastic completely fills the interior cavity of the mold where the sole of the shoe is to be formed. Once the mold-filling material sufficient cools, it becomes solid and strongly attached to the upper along its lower border. The mold is then opened and the injected shoe is removed for finishing steps such as cutting away plastic leakings, inserting an insole, attaching labels, and/or laces. The finished shoe is then checked for imperfections and packaged.

Although the above mentioned procedure is efficient for producing shoes whose uppers are designed to cover the foot in continuous fashion all around, it becomes problematic if used to make shoe styles having an open heel, toe or sides. Such styles are characterized by uppers having an absence of upper material in some of those areas, and an empty space is left at the lower part of the upper. In order to limit the superior border of the injection cavity (corresponding to the superior border of the injected sole), a very precise adjustment of mold is needed for filling empty space left by the lack of upper material between mold sides and last, in the open areas of the upper. Also, to obtain proper and reproducible results a very precise position of the upper on the last in proximity to the lower border of the upper is required (where the sides of the mold will press against the last when mold is shut). It is at this location where the material comprising the upper is normally present but is missing in these styles. If the position of the mold is not precisely correct in this location, a defective shoe may result. First, an imprecise position may result in excess pressure on the upper that could damage it and a defective shoe could result. Second, the lack of upper in such locations will leave room between the sides of the mold and the last. During injection molding, hot plastic may leak through, resulting in an improperly shaped and defective shoe.

It is also difficult to provide the required position in a vertical direction for the upper when injecting an open heel shoe because, when pulling the lasting string, the upper will be drawn downward disproportionately at the area immediately before the open area of the upper, as there is unequal resistance due to the lack of material at these locations. This results in two problems. The first problem is that the lower border of the upper, which is intended to tightly contact the inferior surface of the last, may not do so at all points of contact. The mold-filling material may leak through any openings between the last and upper, (i.e., at the open areas of the upper) resulting in an incomplete and defective sole. Second, excessive downward movement of the upper on the last may result in a wide-mouthed opening of the shoe (at the opening for inserting wear's foot), resulting in a shoe with poor fit and appearance.

Also, in the case of an open-heeled upper, it is very difficult to attach the stitching string for lasting from the back end of one side of the upper to the beginning of the opposite side.

SUMMARY OF THE INVENTION

It is an object of the present invention to provide a method for efficiently injection molding shoes having at least one open area.

It is another object of the present invention to provide an efficient and cost-effective method for providing open-heeled shoes which provides reproducible results.

In accordance with the above-mentioned objectives and others, the present invention provides a method for injection molding shoes having at least one open area. This method comprises wrap stitching a lasting string to a lower border of an open-heeled upper such that the lasting string is able to slide freely along the lower border, providing a reinforcing means in proximity to a location where the lasting string exits the wrap stitching at the heel area, and securing the lasting string such that the lower border of the upper is tightly attached to contacts the inferior surface of the last.

When the open area of the upper is in the heel, the free ends of the lasting string are preferably located on each side of the upper near the midpoint between the front and back thereof, and more generally in the front half of the upper.

The ends of the lasting string are tied together and are kept substantially stationary by securing means provided on the inferior surface of the last.

In preferred embodiments, the securing means comprise cylindrical attachments such as nails which protrude from the inferior surface of the last about ¾ inch posterior to the location where the lasting string exits the wrapping stitch at the open area.

The reinforcing means preferably comprises stitching the same area of the lower border of the upper 2–3 times on each side about ½ inch from the location where the lasting string exits the wrapping stitch at the open area.

The present invention also relates to an injection mold assembly comprising said last defining an upper portion of said injection mold assembly, a lower mold structure including a mold cavity in a predetermined shape corresponding to the desired shape of a shoe sole, wherein the inferior surface of said last defining an upper limit of said sole.

In preferred embodiments, the last includes holding means on both sides of its leg portion which are able to press against the sides of the upper. The holding means are preferably pressed against the sides of the upper prior to the step of pulling the free ends of the lasting string.

The last having the upper tightly attached thereto is aligned with the lower mold structure having an interior cavity in the shape of a shoe sole. The inferior surface of the last forms the top of the mold cavity. The mold is closed and a suitable mold-filling material is injected into the mold cavity until it is filled.

The finished shoe is removed from the mold after the mold-filling material becomes strongly attached to the lower border of the upper.

In another preferred embodiment of the present invention, limiting means are attached to a lateral surface of the last at the interrupted areas of the upper. The limiting means projects from the lateral surface of the last and fills the empty area in the closed mold which is caused by the interrupted area of the upper.

In yet another embodiment of the invention, the upper is provided with an opening disposed at its toe portion corresponding to an open toe. In this embodiment, it is preferred that anterior limiting means are attached to the inferior surface of the last in the toe area. The anterior limiting means limit the posterior movement of the lower border of the upper in the toe area during the dressing of the last by abutting against the lower border of the toe area at a location corresponding to the desired toe opening.

BRIEF DESCRIPTION OF THE DRAWINGS

The following drawings in which like reference characters indicate like parts are illustrative embodiments of the present invention and are not to limit its scope.

FIG. 2C is a perspective view of the open-heeled upper after the lasting string is stitched on;

Figure 1:
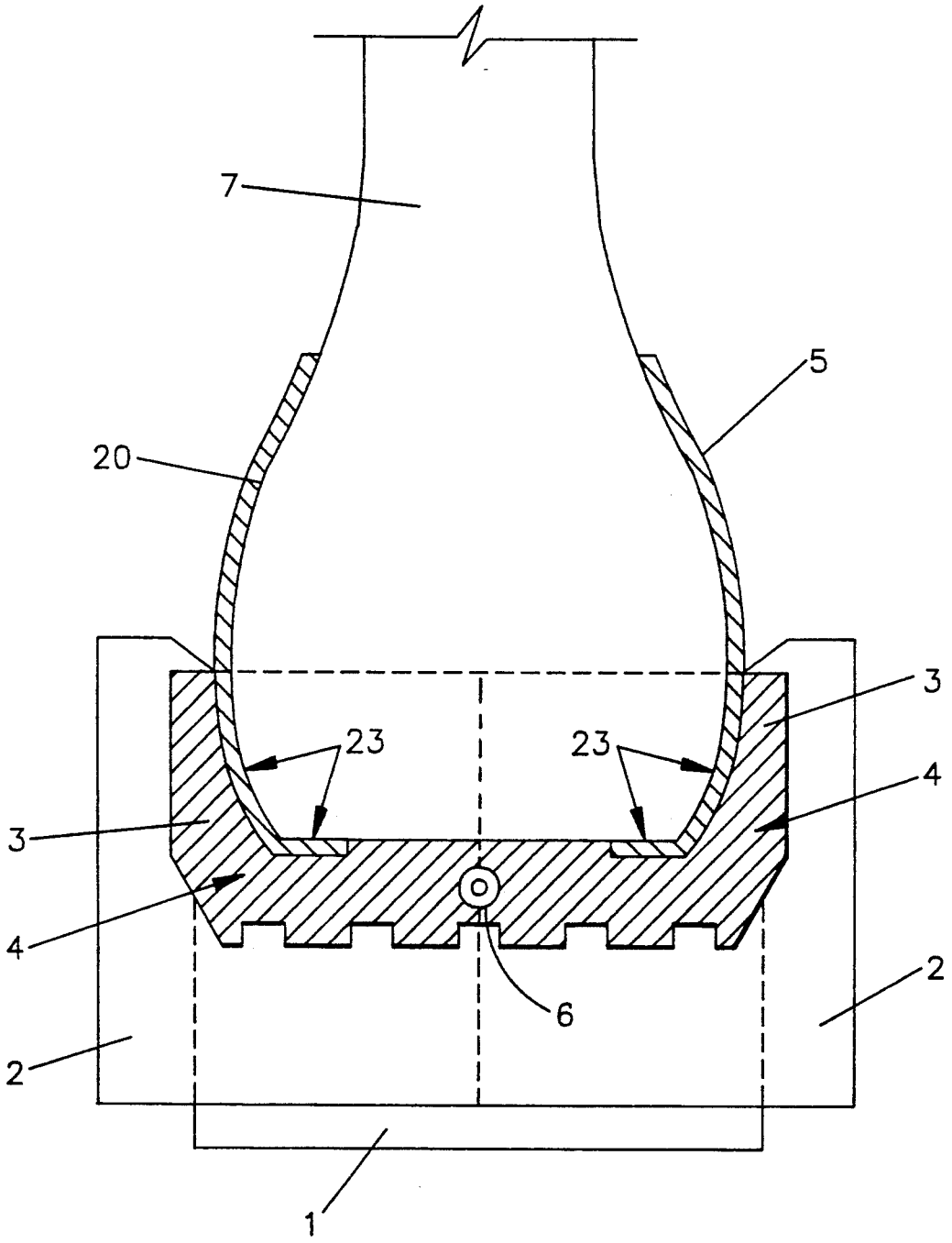
FIG. 1 is a vertical cross-sectional view of an injection mold apparatus used in normal direct injection shoe production.

FIG. **9*a*** shows an upper with lasting margin.

FIG. **9*b*** shows an upper with wrap stitching beginning in the vicinity of a side of the middle of a side of the upper.

FIG. **9*c*** shows the upper with the lasting string stitched around the upper.

DETAILED DESCRIPTION

The upper part of a shoe or "upper" according to the present invention is formed by cutting a suitable material into the desired shape and sewing onto the cut upper various additional pieces for functional and/or decorative reasons (depending on the style). The finished upper includes individual parts such as sides, counter, string for lasting, etc., as well as complementary parts such as bindings, straps, buckles, eyelets, and other decorative or functional parts. Uppers according to the present invention may be made from canvas, vinyl, leather and the like.

Similarly, the sole which is formed by direct injection molding a mold filing material may be manufactured with any such mold filling material, including plastics, rubbers, specialized forms thereof, mixtures of the same and the like.

The uppers used in the present invention will vary in shape and in complementary parts, depending upon the desired style, but will preferentially have an opening in the heel area. The heel area of the upper may include rear extension such as a strap which has the function of holding the shoe to the back of the wearer's foot. The rear extension of the upper, regardless of shape, also has the task of providing tension to the rear of the upper when the upper is placed on the last. The strap may be contiguous with both sides of the upper, or it may be secured on one side of the upper by means of a buckle, velcro, a snap, or a hook. The strap may be elastic or non-elastic. The strap may also be removable.

The lasting string may be slidably attached to the upper by any means known in the art. Preferably, however, this is accomplished by wrap stitching the lasting string about the portion of the lower border of the upper which is to attached to an injected sole.

The stitching steps of the present invention ends with a string for lasting stitched around the portion of the lower border of the upper which is to be attached to an injected sole with a wrapping stitch such that it is attached to the upper, but free to move around the lower border. The stitching begins in the middle of the one side of the upper going forward and follows the lower border of the upper around the toe region and back to the rear border of the upper (at the heel opening).

At that point, reinforcing means are applied to each border. Preferably, the reinforcing means comprises stitching the same spot on the lower border 2–3 times at a location of about ½ inch from the open area or areas of the upper. However, the reinforcing means may comprise a staple, a metal clip, or any other means which will reinforce the wrapping stitch in proximity to an open area of the upper. The wrapping stitch is then cut (without cutting the lasting string).

The stitching of the lower border of the upper continues again by applying a reinforcing means to the lower border of the upper at the opposite end of the interrupted area. Preferably, the reinforcing means comprises stitching the same location 2–3 times on each side of the lower border of the upper about ½ inch from the location where the lasting string enters the wrapping stitch, in this case at the heel area. The wrapping stitch then continues in a normal fashion forward along the lower border of the upper. The stitching is continued such that it makes one and one-half turns around the lower border of the upper, leaving approximately 10 inches at both ends of the lasting string without stitching.

Once the upper is completed, it is firmly attached to the molds last which is thereafter inserted into the mold.

In order to produce direct injection molded shoes having an open heel, the last of the present invention includes the following. First, securing means which comprise protrusions for securing the lasting string are provided on the inferior surface of the last about ¾ inch posterior to the location where the lasting string exits the wrapping stitch at the open heel area. The lasting string is passed behind these protusions when its free ends are pulled to last the upper. The course of the lasting string is thereby shortened as the lasting string is pulled behind the protrusions. The protrusions substantially stop the forward movement of the lasting string in response to the stretching of the same.

The protrusions are preferably cylindrical in shape and are approximately 1/10 inch in diameter. Preferably, at least two protrusions are provided, each located on the inferior surface of the last approximately ¾ inch posterior to the location where the lasting string exists the wrapping stitch and about ½ inch from the edge of the inferior surface of the last, respectively. The protrusions preferably protrude about ½ inch from the inferior surface of the last. In one embodiment, the protrusions comprise nails.

In addition to the protrusions discussed above, the last also preferably includes two holding means located on each side of the leg of the last and slightly behind the anterior portion of the leg. These holding means firmly hold the upper against the last during the string lasting of the upper to the last.

The last also preferentially includes a limiting means of the injection cavity located on the last where open areas of the upper are located. The limiting means completely surrounds the border over the area left open by the interrupted area of the upper. The limiting means projects from a lateral surface of the last and defines a superior border of the injected sole corresponding to the open area. Preferably, the open area is in the heel area of the upper and the limiting means is attached to the heel area.

The limiting means is positioned such that, when the last having an upper attached thereto is placed into the mold, the limiting means takes up the space between the last and the sides of the mold at the open areas of the upper. When the mold is closed, the limiting means contacts the sides of the mold and the last and substantially prevents any leakage of injected sole.

Preferably, the limiting means comprises teflon and is approximately ¼ inch in height and ¼ inch in depth, such that when the limiting means is inserted onto the last, it will project laterally approximately 1/16 inch. This amount of projection is sufficient to cover the space left by the open area of the upper in most cases, depending in part on the thickness of the material comprising the upper.

The presence of the limiting means protects against the formation of a defective shoe by substantially protecting against leakage of the injected sole in the area in question.

If the limiting means are part of the mold (i.e., attached to the sides of mold), the sides of the mold and the last will meet when the mold is closed and the contact between the two parts is metal against metal. If the upper is lasted out of position, which sometimes occurs during mass production, the upper may advance over the heel area. Due to the precise metal to metal fit, there is no room to allow for the extra space taken up by the misaligned upper. When the mold is shut, the sides of the metal mold will press too strongly against the last and may cause damage to the last or produce a defective shoe.

The last preferentially includes engaging means on its inferior surface in proximity to shanks of the last (corresponding to the central portion of the human foot), which is narrower than other areas of the inferior surface. The engaging means is utilized for engaging the lasting string in order to attach and stretch the upper on the last. In a preferred embodiment of the present invention, the engaging means comprises a plurality of hooks which are approximately ¼ inch high and which are located approximately ½ inch from the edge of the inferior surface of the last. In a further preferred embodiment, two or three pairs of the hooks are provided.

In another preferred embodiment, the inferior surface of the last includes standing elements which are located mainly in the heel area. These standing elements are included in order to reduce the amount of mold filling material used, and therefore lighten the sole.

When the open-heeled shoe has a continuous, non-elastic and non-removable strap to hold the shoe on the wearer's foot, an articulated heel is required on the last in order to last the upper. The articulated heel begins in the foreward position when the upper is being attached to the last. The heel strap is passed around the articulated heel and then the articulated heel is moved to an backward position (lengthening the last to its normal length), thereby stretching the strap and pulling the upper posteriorly. Once the sole is injected, the heel strap is released by returning the articulated heel to the closed position (thereby shortening the last).

In one embodiment of the present invention, the shoe is provided with an open toe in addition to an open heel. In this case, it is preferred that the open toe be provided in accordance with the method taught in U.S. patent application Ser. No. 211,766, filed Jun. 27, 1988 (Hirmas), hereby incorporated by reference.

The open toe may be formed by cutting the upper in one piece with a "U" shape beginning in the toe area and developing both sides as to cut extends to the rear and uniting the anterior sides by stitching at the anterior border; by including a forward extension on the lower border of the toe opening which unites the sides of the upper; or by forming the toe opening as a partially closed cut wherein the lower anterior border of the upper is contiguous. In each of these embodiments, the lasting string is stitched around the toe opening with the wrapping stitch.

In the embodiment having an open toe, it is preferred that the last be provided with anterior placement means which project from the anterior inferior surface of the last such that the position (the amount of folding over) of the forward extension, the bridge piece, or the contiguous section of the upper is limited by abutting against the anterior placement means when the lasting string is pulled tightly. The anterior placement means thereby accurately determines the positioning of the open toe on the finished shoe.

Preferably, the anterior placement means comprises one or more metal protrusions which are approximately ½ inch in height. In a further preferred embodiment, these metal protrusions comprise cylindrical bodies or nails which are inserted into the inferior surface of the last and bent forward (toward the anterior end of the last) to a precise location, depending upon where the open toe is desired to arrive once the string for lasting is pulled.

In the open toe embodiment, a non-metallic insert is preferentially included on the last in an area corresponding to the hole in the toe portion of the upper in order to fill the empty space and substantially avoid leakage of the injected sole into undesired areas.

Referring to the drawings, FIG. 1 shows a typical injection molding assembly according to the present invention. The mold assembly when shut leaves at its interior the molding cavity 4 formed by two sides 2, a bottom 1 and the last 7 at the top dressed with the upper 20 attached on it where the sole is to be molded. The mold injection cavity and last is provided in a size and style according the precise shoe to be produced. There must always be a pair of molds, as one is to produce right shoe and the other for the left one. When the last is placed into molding position, a molding cavity 3 is formed with the desired sole shape and size. The mold itself is made from a metal alloy. The mold sides and bottom are attached with screws in order to keep the attached to mold carrier position.

The last 7, is shown with an upper 20 attached. The upper includes an upper portion 5 and a lower border 23 which is placed within the mold cavity 3.

Figure 2A:
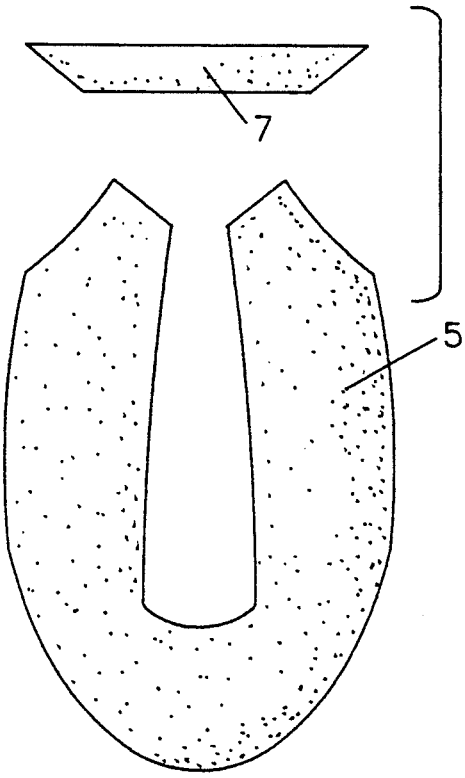
FIG. 2A is a perspective view of an open-heeled upper and a heel strap.
Figure 2B:
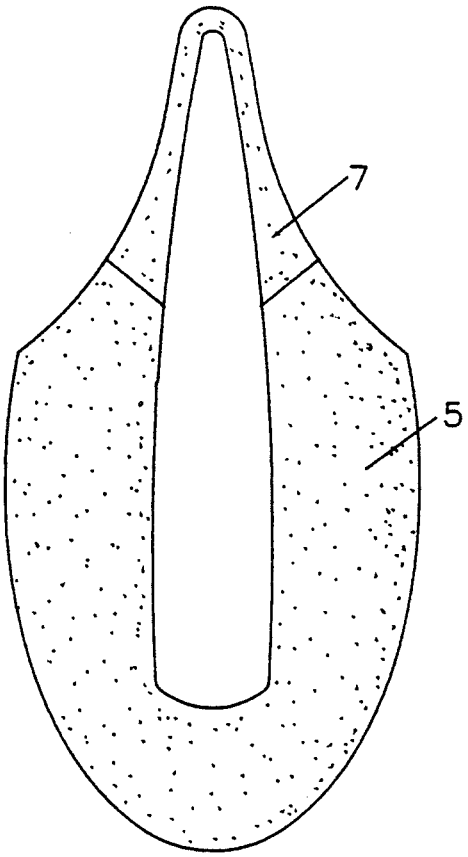
FIG. 2B is a perspective view of the open-heeled upper with the heel strap attached.
Figure 2C:
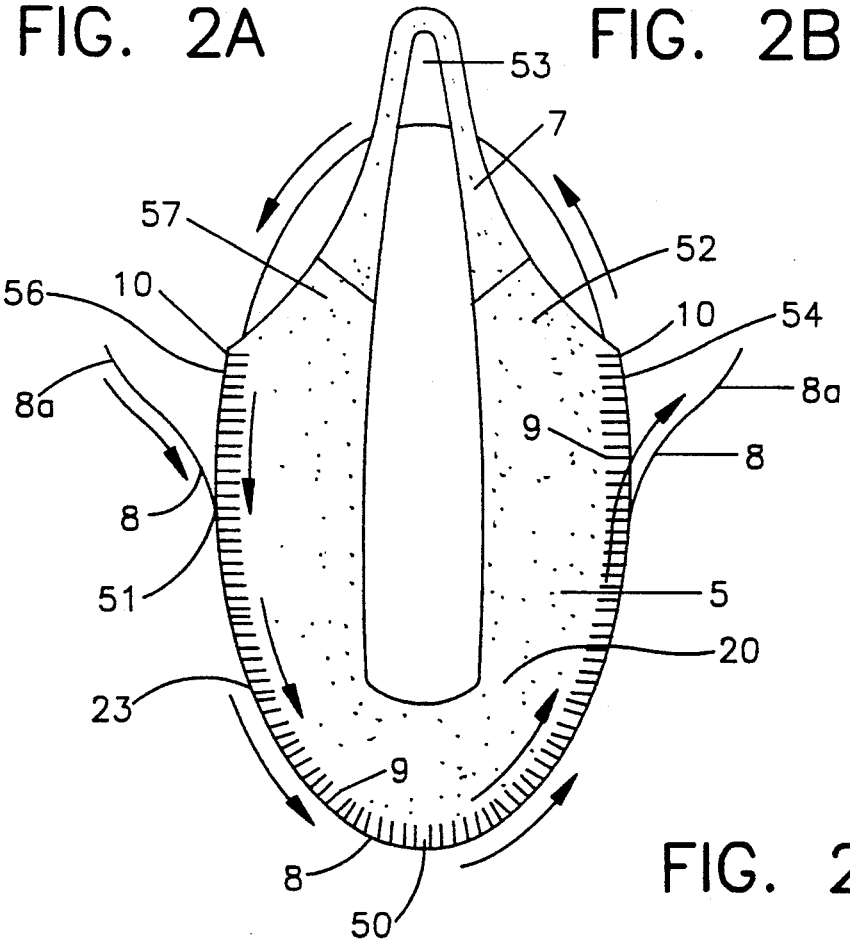

Referring now to FIGS. 2A–C, one possible manner in which an upper having an open heel is formed is by stitching a front portion of the upper 20A and a heel strap 20B (FIGS. 2A and 2B). FIG. 2C shows the wrapping stitch 9 and reinforcement stitching 10 at the beginning of the open area at the heel area on both sides of the upper. The lasting string 8 is located within the wrapping stitch 9. Approximately 10 inches of the lasting string 8 at either end 8A is not surrounded by the wrapping stitch 9.

As shown in FIG. 2C, the result of the stitching steps of the present invention is a string for lasting 8 stitched around the portion of the lower border 23 of the upper 20 which is to be attached to an injected sole. The lasting string 8 is attached to the upper 20 with a wrapping stitch 9. The lasting string 8 is attached in such a way as to be free to slide along the lower border 23. The wrap stitching 9 begins (the starting point) at about the middle of one side 51 of the upper 20; the wrap stitching 9 continues forward and follows the lower border 23 around the toe region 50 and back towards the rear 52 of the upper (at the heel opening 53).

At this point, reinforcing means 10 are applied to the back end 54 of the lower border 23. Preferably, the reinforcing means 10 comprises stitching the same spot on the lower border 2–3 times at a location about ½ inch from the open area 53 or areas (including an open toe, FIG. 3) of the upper 20. The reinforcing means 10 may also comprise a staple, a metal clip or any other means which will reinforce the wrapping stitch in proximity to an open area 23 of the upper 20. The wrapping stitch 9 is then cut, without cutting the lasting string 8.

The stitching of the lower border 23 continues by applying a reinforcing means 10 to the back end 56 of the lower border 23 at the first side. The reinforcing means 10 is located about on the last ½ inch of the lower border 23 at the back end 56 where the lasting string 8 enters the wrapping stitch 9. The wrapping stitch 9 then continues along the first side in a normal fashion forward along the lower border 23 of the upper 20. The process continues until the lasting string makes one and one-half turns around the lower border 23 of the upper 20, exiting the lower border without wrap stitching, and leaving approximately 10 inches 8A of the lasting string 8 loose and able to slide along the lower border 23 for attaching the upper to the last.

FIGS. 3A–D, show the embodiment of the present invention in which the upper has an open toe in addition to an open heel.

Figure 3A:
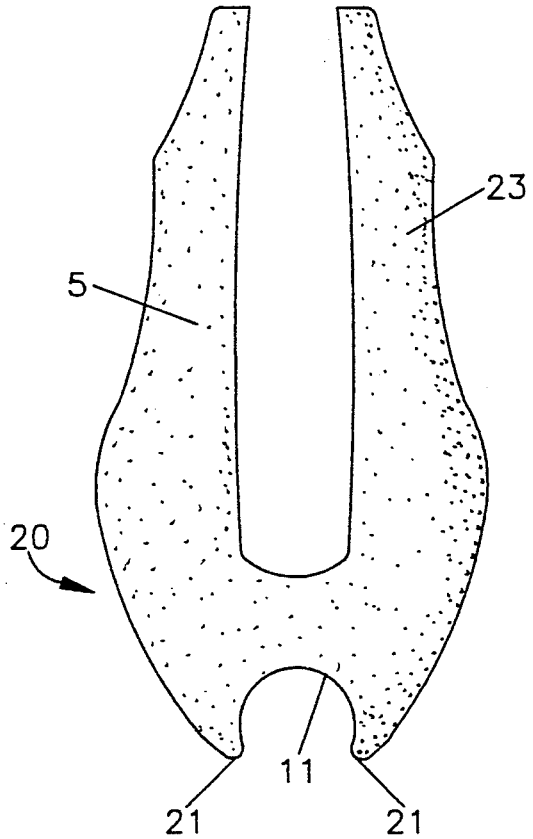
FIG. 3A is a perspective view of an open-heeled and open-toed upper before the string for lasting is stitched therein.

In FIG. 3A, a forward extending 21 is included on the lower border 23 of the upper 20 around the toe opening 11. The forward extensions in this embodiment are stitched together.

Figure 3B:
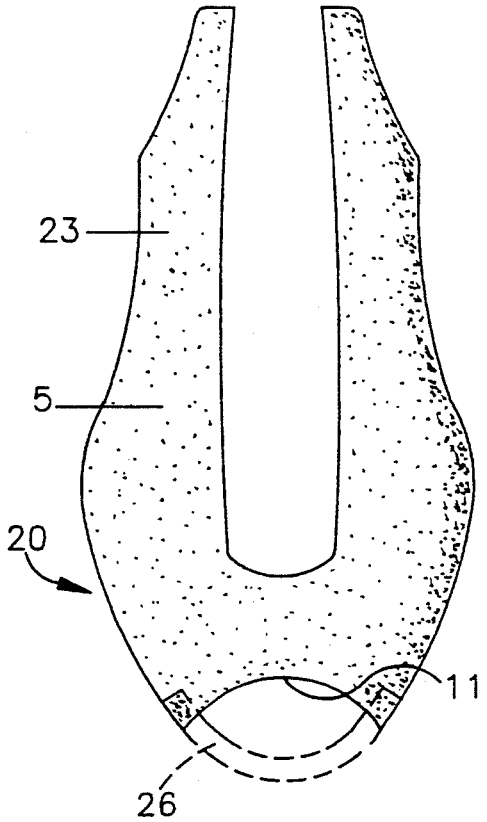
FIG. 3B is perspective view similar to FIG. 3A, except with an embracing or bridging piece attached to the lower forepart of the upper.

In FIG. 3B, the lower border 23 of the upper 22 united at the toe opening by a bridge piece 26 which is made from any suitable material.

Figure 3C:
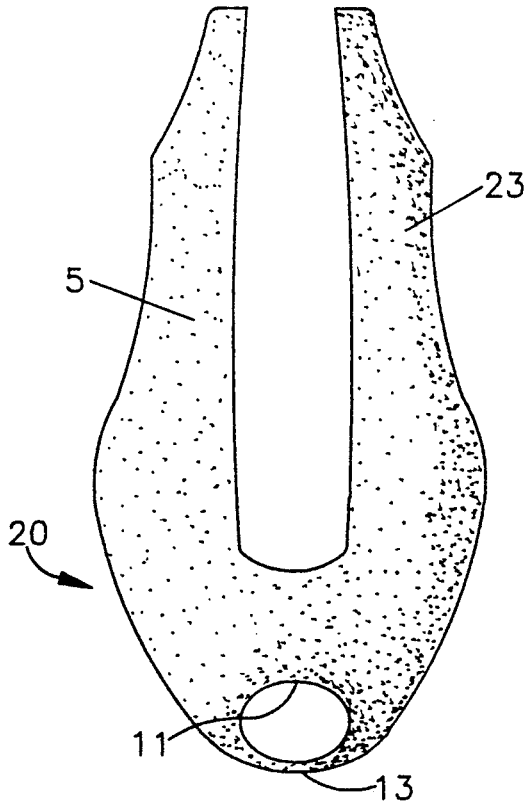
FIG. 3C is a perspective view of an open-toed upper wherein the lower border of the upper has not been interrupted.

In FIG. 3C, the toe opening 11 is a partially closed low cut and the lower border 23 of the upper 20 is contiguous.

Figure 3D:
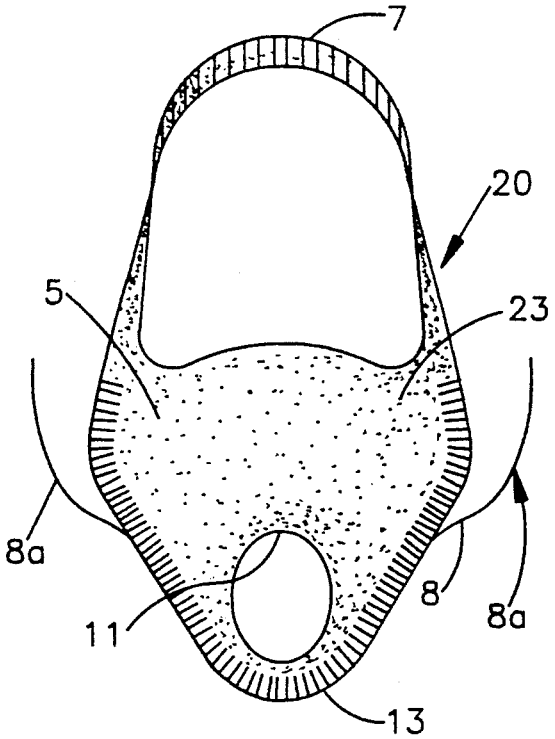
FIG. 3D is a perspective view of the open-toed upper of FIG. 3C after the string for lasting is stitched therein.

In FIG. 3D, the lasting string 8 and the wrapping stitch 9 is shown extending around the lower border. Although the open toe embodiment is a contiguous portion of the upper (See FIG. 3C), the stitching will similarly pass through the toe portions of the uppers depicted in FIGS. 3A and 3B. In each of the embodiments shown in FIGS. 3A–C, a reinforcing stitch is provided on the lower border of each side of the upper about ½ inch from the location where the lasting string exits the wrapping stitching, at the open heel area.

Figure 4:
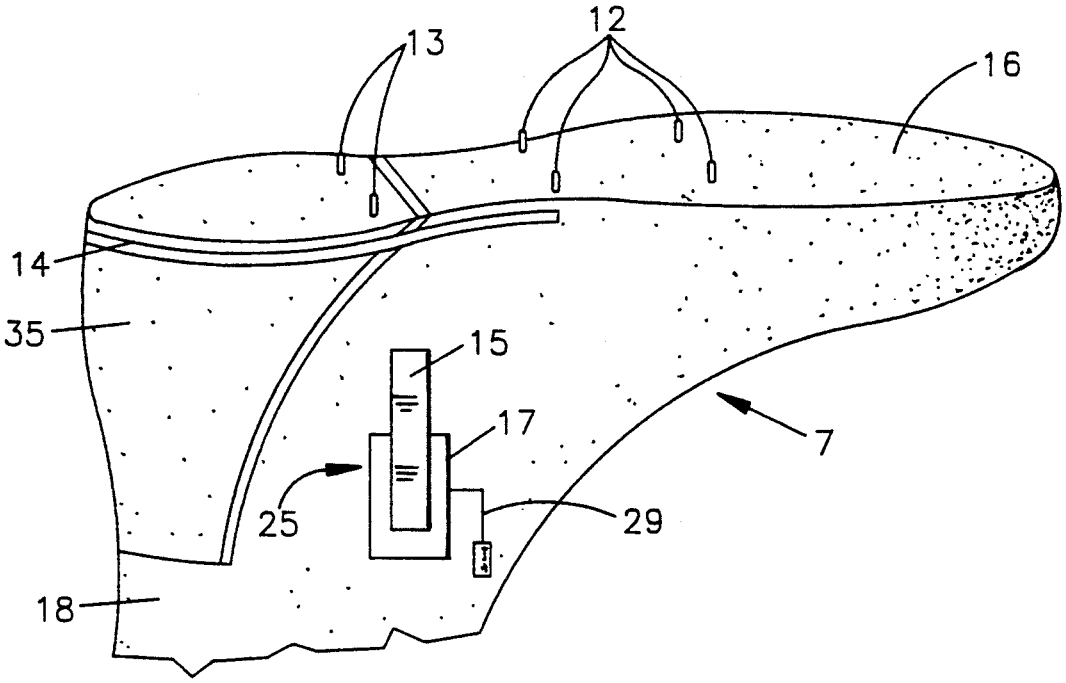
FIG. 4 is a side view of a last according to the present invention.

FIG. 4 is a side view of a last 7 according to the present invention. In this embodiment, the last 7 has an articulated heel 35, and the upper will be provided with a continuous, non-elastic and non-removable heel strap. Also shown is a holding means 25 located on an anterior portion of the leg 18 of the last 7. The holding means 25 has a crowbar 29 and a base 17. Movement of the crowbar 29 places the holding means 25 either in an engaged or released position.

Figure 5:
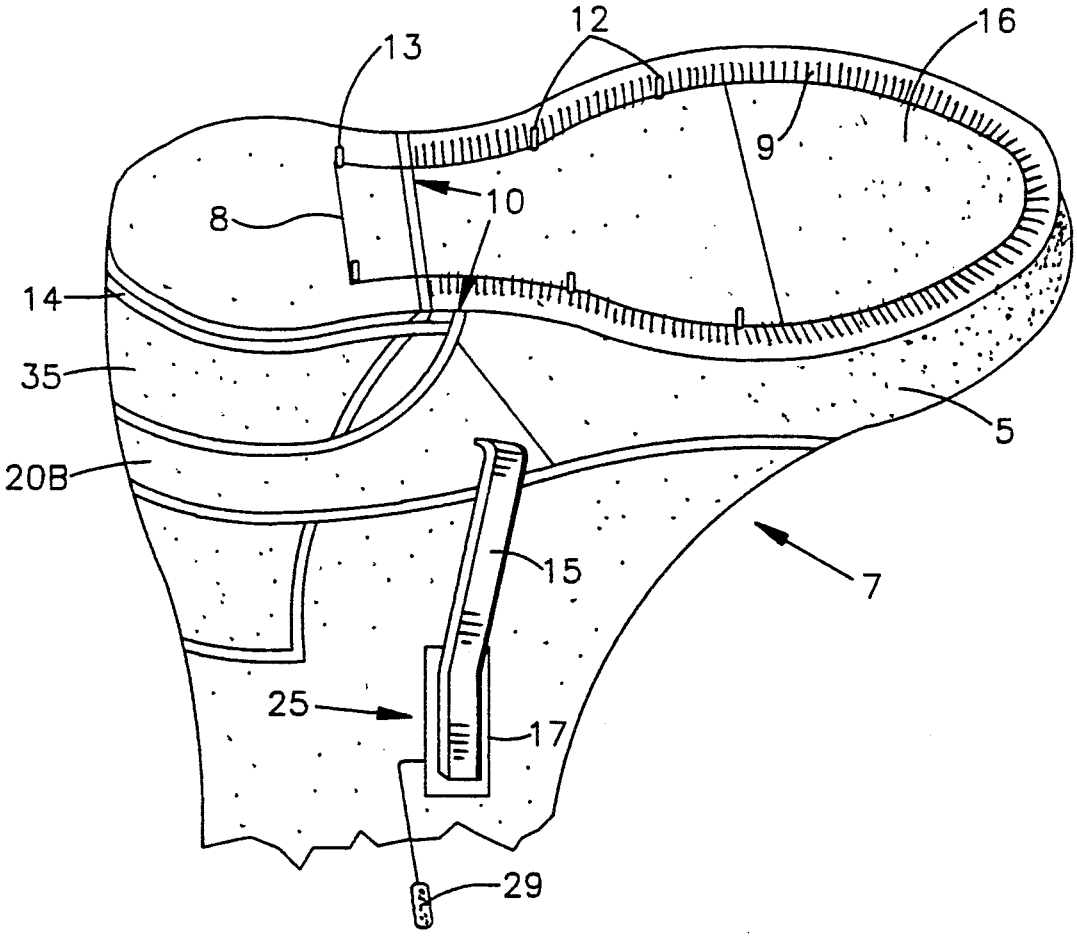
FIG. 5 is a side and inferior view of the last with the lasted upper according to the present invention.

FIG. 5 shows another view of a last 7 according to the present invention which has an upper 20 attached. The limiting means 14 is shown attached to the last 7 at the lower lateral posterior border corresponding to the heel area. In addition, securing means 13 are located on the heel area of the inferior surface 16 of last 7. In this embodiment, the securing means comprise nails. Also shown are engaging means 12 located in proximity to the outline of the inferior surface 16 of the last 7. In this embodiment, the engaging means 12 comprise a plurality of anchoring hooks.

Figure 6:
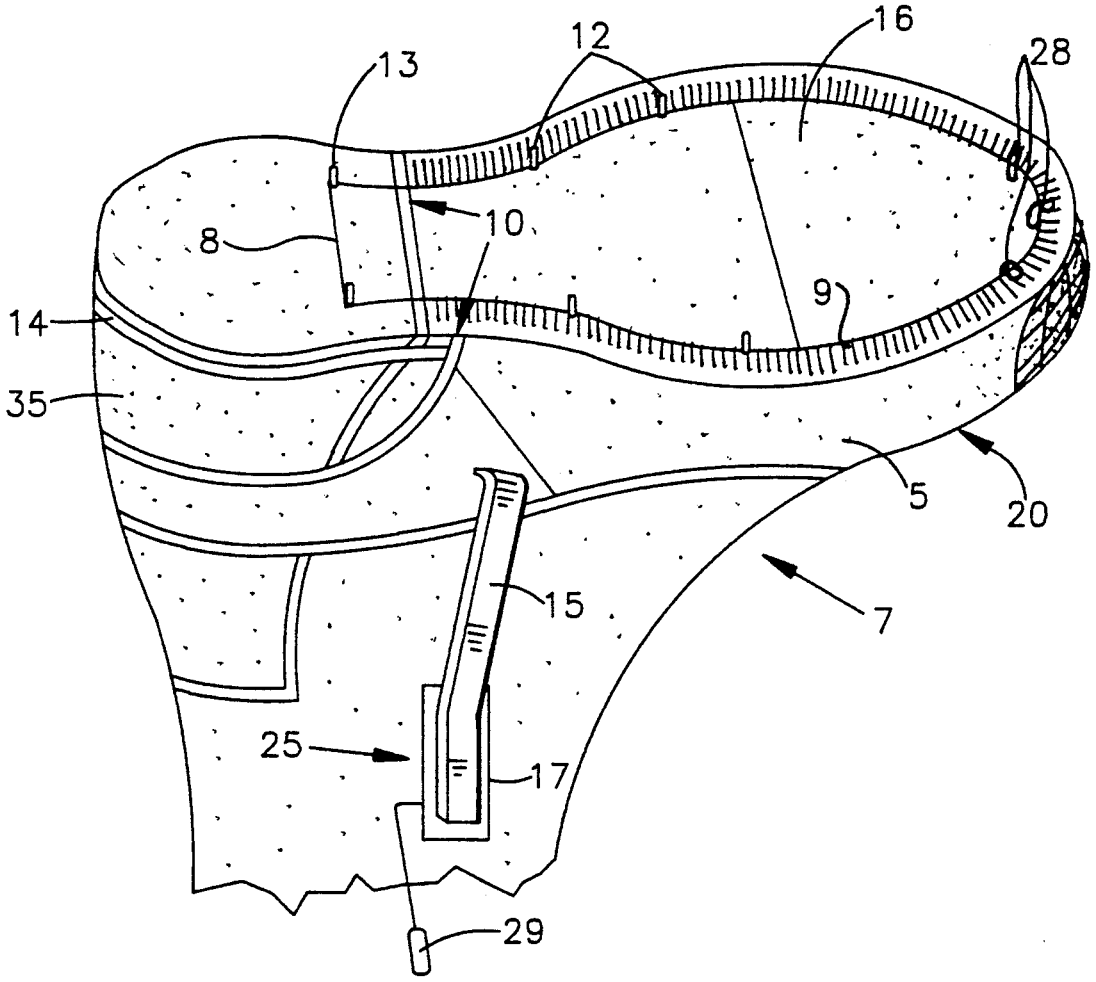
FIG. 6 is a side and inferior view of the last with a lasted upper having both an open heel and an open toe.

FIG. 6 shows a similar view as FIG. 5, except that in addition to an open heel, an open toe is provided. In order to assure the correct positioning of the open toe in the finished shoe, anterior limiting means 28 are provided on the inferior surface 16 of the last 7. In the embodiment shown herein, the anterior limiting means 28 comprise nails. The anterior limiting means 28 are located in a precise location on the inferior surface 16 such that they limit the amount of folding over of the forward extensions 21, bridge piece 26, or the contiguous section 27 of the upper by the abutting against the same when the last string 12 is pulled tightly, and thereby accurately determining the positioning of the open toe on the finished shoe. A non-metallic inset (not shown) is preferentially included on the last area corresponding to the hole in the toe.

Figure 7:
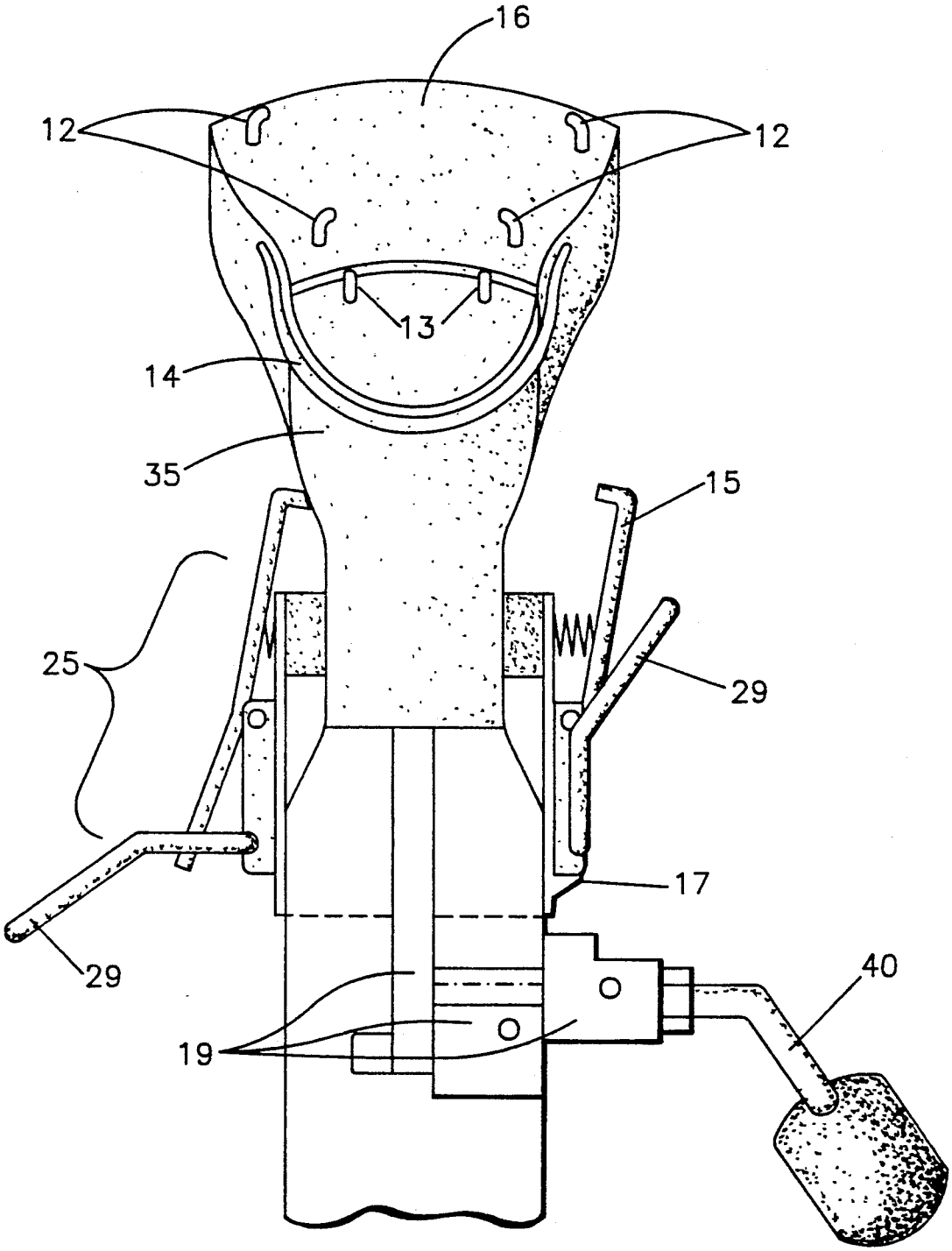
FIG. 7 is a posterior view of the last according to the present invention.

FIG. 7 is a posterior view of the last 7. This Figure shows the mechanism of the articulated heel assembly 19. The crowbar 40 of the articulated heel assembly 19 permits the movement of the articulated heel 35 into a closed position. The position of the last which corresponds to the wearer's foot becomes shorter when the articulated heel is in the closed position. This allows the heel strap 7 to be placed around the posterior of the articulated heel 35. The crowbar 40 also permits the articulated heel 35 to be moved into an open position which corresponds to a normal length of the last, corresponding to the normal length of the foot. Positioning the articulated heel 35 in such a manner allows the upper 20 which has a non-elastic, non-removable heel strap 20B to be tightly attached to the last 7, by pulling the strap of the upper backward.

In order to attach an open-heeled upper 20 which has a non-elastic, non-removable heel strap, the last 7 is shortened by means of the articulated heel 35. The toe portion of the last 7 is then introduced into the toe portion of the upper 20 such that the border of the toe portion of the upper is approximately ½ inch beyond the anterior edge of the last. With one hand the worker holds the upper in that position on the last, while with the other hand, the heel strap of the upper 20 is passed around the articulated heel 35 (which is in the closed position). The crowbar 40 of the articulated heel assembly 19 is then placed in the open position, stretching the heel strap and pulling the upper posteriorly.

When the upper 20 is provided with an open toe, the lasting of the upper is less difficult as the worker does not have to hold the upper 20 in position on the last. Rather, the toe portion of the last is simply inserted into the opening of the upper 20.

Next, the holding means 25 is engaged by use of the crowbar 29. The free lasting string 8 at heel area is then placed behind the securing means 13. The lasting string 8 is pulled (with the worker's free hand in the closed toe embodiment) until the lower border 23 of the upper 20 is folded beneath the inferior face 16 of the last 7. The worker can now take the other hand out of the upper's toe and pull both ends of the lasting string 8 tighter. The lasting string 8 shortens its course and pulls the upper 20 downward up to the limit that the holding means 25 will allow (i.e., until the lower border of the upper is completely attached to the inferior surface of the last 7). The ends 8A of the lasting string 8 are then tied together and the remaining free ends are cut. The lasting string 8 is hooked onto the engaging means 12.

The last 7 having the upper 20 attached thereto is then placed in the injection position in the mold assembly. The injector approaches the mold and touches the mold at the injection point 6, through which it will inject hot melted plastic, rubber or the like into the cavity of the mold to fill the sole.

Once the injected material cools sufficiently, it becomes solid and forms the sole of the shoe, which remains firmly attached to the upper.

The finished shoe is then removed from the mold by releasing the holding devices, etc. and taking the strap off the heel. Finishing steps may then be performed such as cutting any excess plastic, etc. which might have leaked and any thread which ravelled out, inserting an insole, and attaching labels and other parts depending on style. Finally, after checking quality, the shoes are packed for shipment.

Figure 8A:
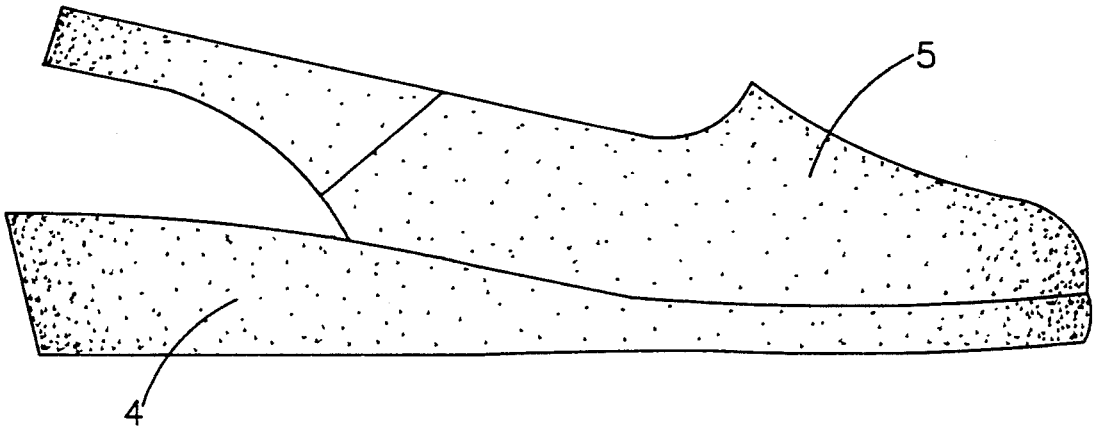
FIGS. 8A and 8B are side views of a couple of open heel shoe styles, once finished.
Figure 8B:
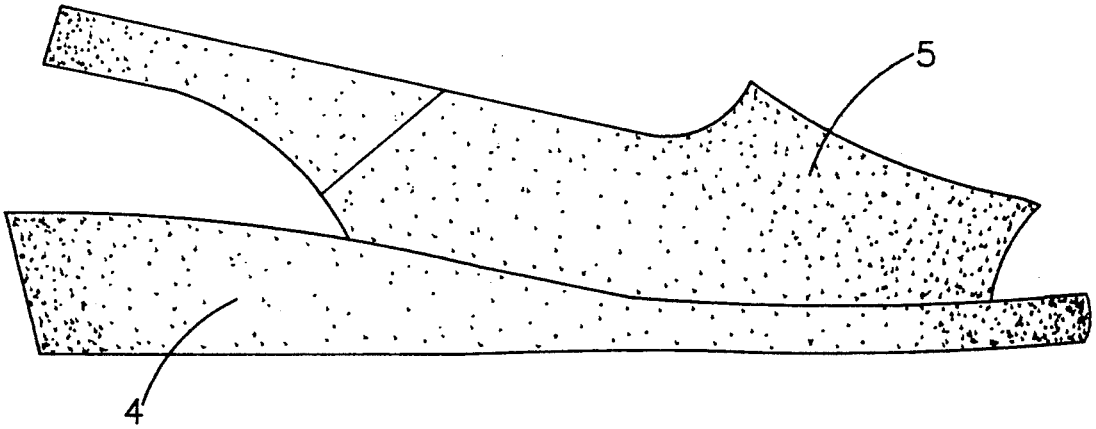

FIGS. 8A and 8B show the completed shoe with an open heel having an injected sole 4. The completed shoes shown in FIGS. 8A and 8B have a closed toe and an open toe, 24 respectively.

Figures 9A, 9B, 9C:
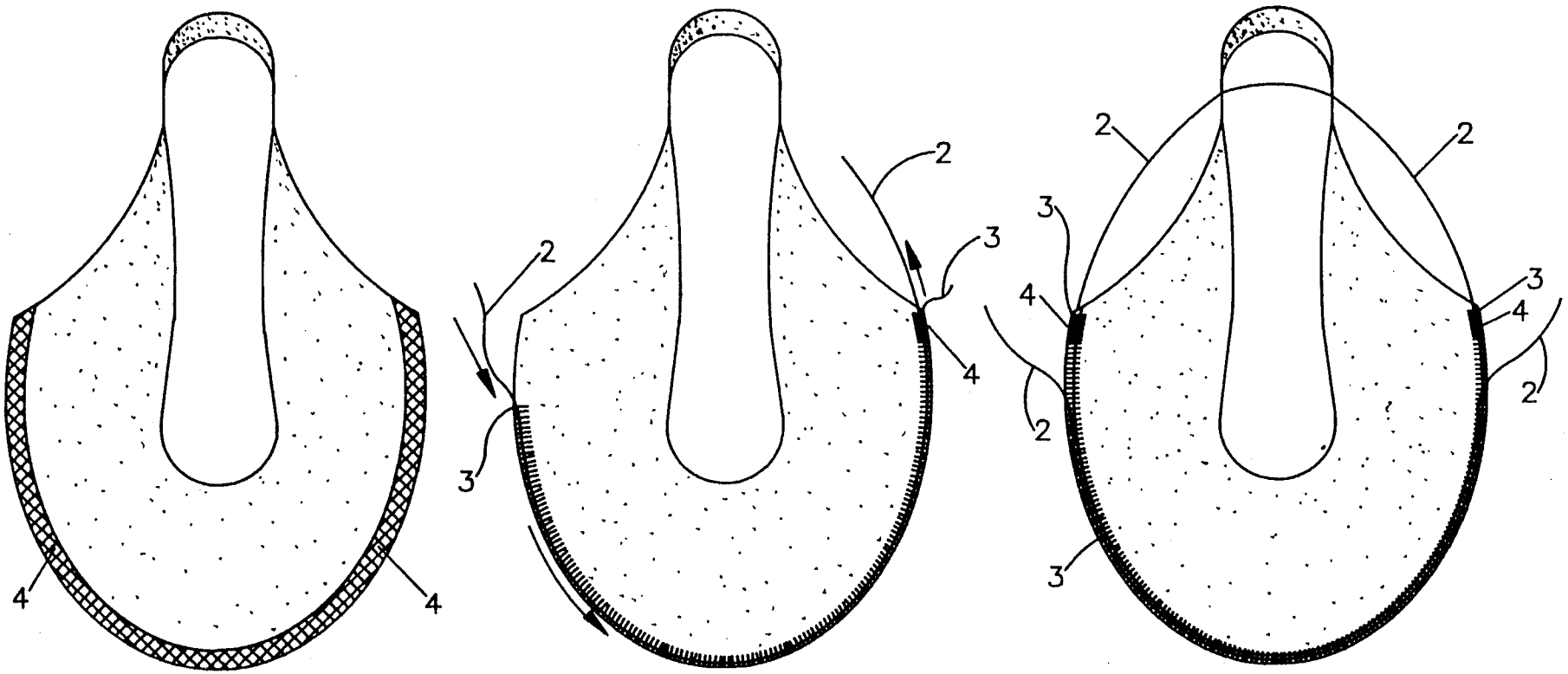

FIG. 9*a* shows the lasting margin. FIG. 9*b* shows the wrap stitching 3 beginning in the vicinity or slightly forward of the middle of a side of the upper. The lasting string 2 is attached at the lasting margin 1. The wrap stitching 3 is reinforced 4 at the back end of the opposite side. The lasting string 2 continues to be wrap stitched 3 around the upper until it reaches about the middle of the opposite side, as shown in FIG. 9*c*. The wrap stitching is also reinforced 4 at the back end of the first side. The lasting string 2 makes one and one half turns around the upper.

The examples provided above are not meant to be exclusive. Many other variations of the present invention will be obvious to those skilled in the art, and are contemplated to be within the scope of the appended claims.

I claim:

1. A method for string lasting a shoe upper having a toe region, a heel region, a first side, and a second side for subsequent injection molding wherein the completed shoe is to have an open heel, and the shoe upper has a lasting margin disposed along the lower border of the shoe upper except at the open heel region and a lasting string attached to the lasting margin of the upper, the method comprising, wrap stitching the lasting string along the lasting margin, beginning the wrap stitching near the middle of the first side of the shoe upper, leaving about ten inches of the lasting string protruding from the first side of the shoe upper, continuing the wrap stitching toward the toe region of the shoe upper, following the lower border of the shoe upper around the toe region, turning back on the second side of the upper and continuing the wrap stitching until arriving at the heel region of the lasting margin, applying a first reinforcement means for the wrap stitching beginning about one-half inch forward of the heel region and continuing for about one-half inch in a direction toward the heel region of the lasting margin on the second side of the shoe upper, cutting the wrap stitching without cutting the lasting string, applying a second reinforcement means beginning on the heel region of the lasting margin on the first side of the shoe upper and extending toward the toe region for about one-half inch from the heel region, continuing the wrap stitching of the lasting string on the lasting margin beginning near the heel region of the first side, continuing the wrap stitching toward the toe region of the shoe upper, following the lower border of the shoe upper around the toe region, turning back on the second side of the upper so that the lasting string makes one and one-half turns around the lasting margin, exiting the lower border near the middle of the second side, and leaving about 10 inches of the lasting string protruding from about the middle of the second side of the lasting margin without wrap stitching so that the lasting string is able to freely slide along said lower border.

2. The method of claim 1, wherein said first and second reinforcement means comprises repeating the wrap stitching at least two times.

3. The method of claim 2, wherein said first and second reinforcement means comprises a clip or a staple.

* * * * *